United States Patent [19]

Takaoka et al.

[11] Patent Number: 4,788,118

[45] Date of Patent: Nov. 29, 1988

[54] ELECTROPHOTOGRAPHIC PLATE FOR PRINTING PLATE MAKING

[75] Inventors: Kazuchiyo Takaoka; Takao Senga, both of Nagaokakyo, Japan

[73] Assignee: Mitsubishi Paper Mills, Ltd., Tokyo, Japan

[21] Appl. No.: 23,259

[22] Filed: Mar. 9, 1987

[30] Foreign Application Priority Data

Mar. 18, 1986 [JP] Japan ..... 61-61909

[51] Int. Cl.[4] ..... G03G 13/32

[52] U.S. Cl. ..... 430/49; 430/96

[58] Field of Search ..... 430/49, 66, 67, 96, 430/329

[56] References Cited

U.S. PATENT DOCUMENTS 4,254,163 3/1981 Piazza ..... 430/329

4,565,759 1/1986 Tsutsui ..... 430/49

*Primary Examiner*—John L. Goodrow

*Attorney, Agent, or Firm*—Cushman, Darby & Cushman

[57] ABSTRACT

An electrophotographic plate for making printing plate comprises a conductive support and a light sensitive layer which comprises a photoconductive substance, an alkali soluble resin binder and an organic polymer fine powder of 10 μm or less in particle diameter. According to this electrophotographic plate, dissolving-out of non-image area of the light sensitive layer is promoted and higher printing endurance is provided.

11 Claims, No Drawings

ELECTROPHOTOGRAPHIC PLATE FOR PRINTING PLATE MAKING

BACKGROUND OF THE INVENTION

This invention relates to an electrophotographic plate for electrophotographic printing plate making.

Hitherto, there have been known light sensitive materials for lithographic printing plate, which use light sensitive resins or silver halide light sensitive materials. However, although lithographic printing plates made using light sensitive resins are high in printing endurance and excellent in image reproducibility, they have defects that sensitivity is low and sensitive wavelength region is on the short wavelength side. Therefore, there have been problems that they are not suitable for direct plate making from originals and besides light sources are limited for laser scanning.

Furthermore, printing plates according to diffusion transfer development or hardening development of silver halide light sensitive materials can be produced with satisfactory sensitivity, but they also have the defects of poor printing endurance and high cost for one plate.

As materials for direct plate making by electrophotography, there have been known those of zinc oxide-resin dispersion type. In case of printing plate of this type, charged latent image is formed on a zinc oxide-resin dispersion coating film by exposure to light in an imagewise manner and is developed with a toner and finally non-image area is rendered hydrophilic. The printing plate made in this way is damaged in its surface hydrophilic layer due to rupture of layer caused by mechanical pressure during printing or by permeation of damping solution into light sensitive layer (conducted layer) and so such printing plate is also inferior in printing endurance like printing plate of silver halide light sensitive type.

On the other hand, for printing plates according to electrophotography, there have been known light sensitive materials which comprise a conductive support sandblasted and rendered hydrophilic and an electrophotographic light sensitive layer of an alkali-soluble resin provided on the support. Plate making is carried out by charging and exposing the light sensitive layer, developing the latent image with a toner and removing the light sensitive layer of non-image area by an alkali solution for dissolving-out of the layer. As a result, there are formed non-image areas of hydrophilic surface of aluminum oxide and image areas of electrophotographic light sensitive layer which are covered with toner.

Thus, printing plates according to electrophotography have the advantages that they are superior in printing endurance and further, sensitive wavelength region can be optionally determined by selection of organic photoconductive substances. However, these printing plates are made through the step of dissolving-out of the non-image area with an alkali and hence the image reproducibility delicately depends on the balance between alkali-solubility of resin and resin-dissolvability of alkali.

Especially important problem is that dissolving-out property of non-image area varies at interface between light sensitive layer and support and dissolving-out property of light sensitive layer at that portion deteriorates to leave residues and when dissolving-out property of light sensitive layer is increased for removing the residues, printing endurance becomes inferior.

SUMMARY OF THE INVENTION

It is an object of this invention to provide an electrophotographic plate which comprises a conductive support and an alkali soluble electrophotographic light sensitive layer provided on the support for electrophotographic printing plate making wherein dissolving-out property of the light sensitive layer is promoted and besides a high printing endurance is provided.

DESCRIPTION OF THE INVENTION

The electrophotographic plate for electrophotographic printing plate making of this invention is characterized in that the electrophotographic light sensitive layer formed on the conductive support comprises a photoconductive substance, an alkali soluble resin binder and an organic polymer fine powder of 10 μm or less in particle diameter.

The electrophotographic light sensitive layer may be of single-layer structure or laminate structure of function-separated type, but effect of this invention is conspicuous in the single-layer structure.

The organic polymer fine powder of 10 μm or less in particle diameter must be able to be used in combination with the alkali soluble resin. Furthermore, the organic polymer fine powder must not be dissolved or molten at the time of formation of electrophotographic light sensitive film to mix with the alkali soluble resin and must be present as a fine powder in the light sensitive layer. Preferably, there appear on the surface of the powder a polar group such as carbonyl group, carboxyl group, hydroxyl group, carbamoyl group, alkoxy group, aryloxy group, sulfonyl group, alkoxycarbonyl group, aryloxycarbonyl group or cyano group to give interaction with the alkali soluble resin.

Particle diameter of the fine powder may be 10 μm or less, preferably 3 μm or less in view of dispersion stability and image reproducibility at development and desirably 0.1 μm or more considering redispersibility and adsorption to the conductive support having an oxide layer.

As the fine powder having such properties, mention may be made of, for example, polymers produced by emulsion polymerization in water such as methacrylic acid-methyl methacrylate-methacrylic acid ester (ester moiety contains aliphatic group such as propyl, butyl, etc.) copolymer, methyl methacrylate polymer, methyl methacrylate-methacrylic acid ester (ester moiety contains aliphatic group such as propyl, butyl etc.) copolymer, styrene polymer, styrene-acrylic acid copolymer, styrene-acrylic acid-acrylic acid ester (ester moiety contains aliphatic group such as methyl, ethyl, propyl, butyl, etc.) copolymer or these polymers which are crosslinked to be made insoluble in solvents. However, there are no limitations.

When the light sensitive layer is a single layer, the fine powder is uniformly present in this layer and when a multi-layer, it is present in at least one of the layers.

The alkali soluble resin means a resin which becomes soluble in an aqueous or alcoholic solvent by addition of an alkali. For the resin, film-forming property, electrical properties and adhesion strength onto the support are important and furthermore, solubility characteristics in alkali solutions and dispersion stability are also important.

As examples of resins having such properties, mention may be made of acrylic resins and phenolic resins such as vinyl acetate-crotonic acid copolymer, styrene-maleic anhydride copolymer, styrene-acrylic acid-acrylic acid ester (ester moiety contains aliphatic group such as methyl, ethyl, propyl, butyl, hexyl, 2-ethylhexyl, cyclohexyl, etc.) copolymer, methacrylic acid-methacrylic acid ester (ester moiety contains aliphatic group such as propyl, butyl, hexyl, 2-ethyl hexyl, cyclohexyl, etc.) copolymer, methacrylic acid-methacrylic acid ester-acrylic acid ester (ester moieties contain aliphatic group such as methyl, ethyl, propyl, butyl, hexyl, cyclohexyl, 2-ethylhexyl, etc. or glycidyl group or tetrahydrofurfuryl group) copolymer, but the resins are not limited to these examples. These resins may be used alone or in combination of two or more.

The photoconductive substances used in this invention can be classified into three kinds, namely, charge transporting substances, charge generating substances and substances having both of these properties. Those having charge generating ability are all called charge generating substances.

The charge transporting agents include organic compounds having strong electron donating ability, for example, hydrazones, pyrazoline, diarylalkanes, alkylenediamines, dibenzylanilines, triphenylamines, triphenylmethanes, diphenylbenzylamines, triarylalkanes, anthracenes, oxazoles, oxadiazoles, thiazoles, and poly-N-vinylcarbazole, halogenated-poly-N-vinylcarbazole, polyvinyl pyrene, polyvinylanthracene, polyvinylacridine, polyglycidylcarbazole, polyvinylacenaphthylene, ethylcarbazoleformaldehyde resins, etc., but the present charge transporting agents are not limited to them. They may be used alone or in combination of two or more.

As the charge generating substances, mention may be made of, for example, triphenylmethane dyes such as Methyl Violet, Crystal Violet, Ethyl Violet, Night Blue, Victoria Blue, etc., xanthene dyes such as erythrosine, Rhodamine B, Acridine Red B, etc., acridine dyes such as Acridine Orange 2G, Acridine Orange R, Flaveosine, thiazine dye such as Methylene Blue, Methylene Green, Methyl Violet, etc., oxazine dyes such as Capri Blue, Meldola's Blue, etc., cyanine dyes, styryl dyes, pyrylium salts, thiapyrylium salts, phthalocyanine pigments such as methyl phthalocyanine, metal-free phthalocyanine, etc. and derivatives thereof, porphyrins and derivatives thereof such as metal porphyrin, metal-free porphyrin, etc., perylene pigments such as peryleneimide, perlyenic anhydride, etc., quinacridone pigments, azo pigments, anthraquinone pigments, etc., but the charge generating substances used in this invention are not limited to these exemplified substances.

Amount of the organic polymer fine powder which constitutes the electrophotographic light sensitive layer is preferably about 5–30% by weight of the whole light sensitive layer. Content of the photoconductive substance varies depending on the structure of the light sensitive layer. The alkali soluble resins may be used in admixture or separately depending on the structure of the layer. For example, in case of laminate structure, different resins may be used in charge generation layer and charge transport layer, respectively. However, the organic polymer fine powder is added to at least one of them.

As conductive supports, there may be used those having hydrophilic surface such as aluminum sheet, zinc sheet, bimetal sheets, e.g., copper-aluminum sheet, copper-stainless steel sheet, chromium-copper sheet, etc., trimetal sheets such as chromium-copper-aluminum sheet, chromium-copper-iron sheet, chromium-copper-stainless steel sheet, etc. The thickness thereof is preferably 0.1–1 mm.

Especially, when the supports have an aluminum surface, they are preferably subjected to sandblasting, dipping treatment in an aqueous solution of sodium silicate or sodium phosphate or anodic oxidation.

The anodic oxidation is carried out by passing electric current using an aluminum sheet as an anode in an electrolyte comprising a solution of an inorganic acid such as phosphoric acid, chromic acid, sulfuric acid, boric acid or the like, an organic acid such as oxalic acid, sulfamic acid or the like or a salt thereof.

The following examples further illustrate this invention.

EXAMPLE 1

19.4 parts by weight of ϵ-type copper phthalocyanine (Leophoton manufactured by Toyo Ink Co.), 66.9 parts by weight (solid content) of acrylic resin (A) (methacrylic acid-ethyl methacrylate-propyl methacrylate copolymer) and 13.8 parts by weight of fine poder (A)(-methacrylic acid-methyl methacrylate-divinylbenzene copolymer having a particle diameter of 0.15 μm) were added to 730 parts by weight of methyl cellosolve, followed by adding beads. The mixture was divided and dispersed for 2 hours in a paint conditioner manufactured by Red Devil Co. to obtain a dispersion. This dispersion was coated on a surface treated aluminum sheet (0.24 mm thick) at a thickness of 5 μm to obtain an electrophotographic plate for printing plate making.

EXAMPLE 2

19.4 parts by weight of ϵ-type copper phthalocyanine, 66.9 parts by weight (solid content) of resin (B) (acrylic acid-ethyl acrylate-styrene copolymer), 13.8 parts by weight of PAN (polyacrylonitrile powder having an average particle diameter of 2.6 μm manufactured by Mitsubishi Rayon Co., Ltd.) and 38 parts by weight of 1-phenyl-3-(p-diethylaminostyryl)-5-(p-diethylaminophenyl)pyrazoline were added to 280 parts by weight of toluene and 450 parts by weight of n-butyl alcohol and were dispersed for 2 hours in the paint conditioner used in Example 1 to obtain a dispersion. This dispersion was coated on the same aluminum support as used in Example 1 at a thickness of 5 μm to obtain an electrophotographic plate for printing plate making.

EXAMPLE 3

31.5 parts by weight of azo pigment (Chlor Dian Blue), 27 parts by weight (solid content) of resin (C) (styrene-acrylic acid copolymer) and 11 parts by weight of fine powder (B) (methyl methacrylate-divinylbenzene copolymer having a particle diameter of 0.18 μm) were added to 250 parts by weight of dioxane and were dispersed for 4 hours in a paint conditioner to obtain a dispersion. This dispersion was coated on the same aluminum support as used in Example 1 at a thickness of about 0.3 μm to form a charge generation layer.

Separately, 35 parts by weight of a hydrazone compound (paradiethylaminobenzaldehyde-N,N-diphenylhydrazone), 56.2 parts by weight (solid content) of resin (D) (acrylic acid-butyl acrylate-styrene copolymer) and 16 parts by weight of fine powder (B) were added to 700 parts by weight of toluene and 100 parts by weight of isopropanol and were dispersed for 2 hours in a paint conditioner to obtain a dispersion. The resulting dispersion was coated on said charge generation layer at a thickness of about 4 μm to obtain an electrophotographic plate for printing plate making.

COMPARATIVE EXAMPLE 1

19.4 parts by weight of ε-type copper phthalocyanine and 80.7 parts by weight (solid content) of resin (A) were added to 730 parts by weight of methyl cellosolve and dispersed and coated in the same manner as in Example 1 to obtain an electrophotographic plate.

COMPARATIVE EXAMPLE 2

19.4 parts by weight of ε-type copper phthalocyanine, 80.7 parts by weight (solid content) of resin (B) and 38 parts by weight of pyrazoline compound 1-phenyl-3-(p-diethylaminostyryl)-5-(p-diethylaminophenyl)-pyrazoline were added to 280 parts by weight of toluene and 450 parts by weight of isopropanol and dispersed and the dispersion was coated in the same manner as in Example 2 to obtain an electrophotographic plate for printing plate making.

COMPARATIVE EXAMPLE 3

31.5 parts by weight of an azo pigment (Chlor Dian Blue) and 38 parts by weight (solid content) of resin (C) were added to 250 parts by weight of dioxane and dispersion and coating were carried out in the same manner as in Example 3 to form a charge generation layer.

Separately, 35 parts by weight of a hydrazone compound paradiethylaminobenzaldehyde-N,N-diphenylhydrazone and 72.2 parts by weight (solid content) of resin (D) were added to 700 parts by weight of toluene and 100 parts by weight of isopropanol and dissolved by heating. The resulting solution was coated on the charge generation layer as formed above at a thickness of 4 μm to obtain an electrophotographic plate for printing plate making.

COMPARATIVE EXAMPLE 4

19.4 parts by weight of ε-type copper phthalocyanine and 80.7 parts by weight (solid content) of an acrylic resin (E) (methacrylic acid-ethyl methacrylate-butyl methacrylate copolymer) were added to 730 parts by weight of dioxane and then, dispersion and coating were carried out in the same manner as in Example 1 to obtain an electro-photographic plate for printing plate making.

Next, solutions for dissolving-out the light sensitive layers were prepared.

Solution-1

An aqueous solution of pH=13.2 was prepared from sodium hydroxide and sodium silicate.

Solution-2

An aqueous solution of pH=11 was prepared from sodium metasilicate and amyl alcohol.

The light sensitive layers of the electrophotographic plates produced in Examples 1, 2 and 3 and Comparative Examples 1, 2, 3 and 4 were dissolved-out with these two solutions and times required for dissolving-out were measured. The results are shown in Table 1. Addition of the fine powder promoted the dissolving-out of the light sensitive layers.

Printing endurance tests were carried out as follows. The electrophotographic plates as produced above were subjected to charging, exposing and developing, then to dissolving-out of non-image areas with the solutions indicated in Table 1 and thereafter, to printing endurance test using an offset printing machine OF-CON-204RR manufactured by Ukita Kogyo Co. The results are shown in Table 2. Addition of the fine powder improved the printing endurance.

TABLE 1

Times required for dissolving-out of light sensitive layer.

| | | Time required for dissolving-out |
|---|---|---|
| Example-1 | Solution-1 | 9 sec. |
| Comparative Example-1 | " | 14 sec. |
| Comparative Example-4 | " | 9 sec. |
| Example-2 | " | 15 sec. |
| Comparative Example-2 | " | 19 sec. |
| Example-3 | Solution-2 | 16 sec. |
| Comparative Example-3 | " | 17 sec. |

TABLE 2

Guaranteed number of prints printable without problems using the printing plates made from the electrophotographic plates obtained in the above Examples and Comparative Examples

| | Number of prints |
|---|---|
| Example-1 | 160,000 |
| Comparative Example-1 | 120,000 |
| Comparative Example 4 | 80,000 |
| Example-2 | 160,000 |
| Comparative Example-2 | 110,000 |
| Example-3 | 130,000 |
| Comparative Example-3 | 120,000 |

What is claimed is:

1. An electrophotographic plate for printing plate making which comprises a conductive support and an alkali soluble light sensitive layer provided on said support, said light sensitive layer comprising a photoconductive substance, an alkali soluble resin binder and an organic polymer fine powder having a particle diameter of 10 μm or less.

2. An electrophotographic plate according to claim 1 wherein the light sensitive layer is of single-layer structure.

3. An electrophotographic plate according to claim 1 wherein the light sensitive layer is of multi-layer structure.

4. An electrophotographic plate according to claim 1 wherein the organic polymer fine powder is a methacrylic acid-methyl methacrylate-methacrylic acid ester copolymer, methyl methacrylate polymer, a methyl methacrylate-methacrylic acid ester copolymer, a styrene polymer, a styrene-acrylic acid copolymer, a styrene-acrylic acid-acrylic acid ester copolymer or a crosslinked polymer thereof.

5. An electrophotographic plate according to claim 1 wherein the fine powder has a particle diameter of 0.1–3 μm.

6. An electrophotographic plate according to claim 1 wherein the resin binder is an acrylic resin or a phenolic resin.

7. An electrophotographic plate according to claim 1 wherein the content of the fine powder is 5–30% by weight of the total of the light sensitive layer.

8. An electrophotographic plate according to claim 3 wherein the fine powder is contained in at least one layer.

9. A printing plate made from the electrophotographic plate of claim 1 by subjecting it to charging, imagewise exposure, development and dissolving-out of non-image area.

10. A printing method using the printing plate of claim 9.

11. A method for making a printing plate which comprises subjecting the electrographic printing plate of claim 1 to charging, imagewise exposure, development and dissolving-out of the non-image area.

* * * * *